US007383870B2

(12) United States Patent
Larsen

(10) Patent No.: US 7,383,870 B2
(45) **Date of Patent: *Jun. 10, 2008**

(54) ADJUSTABLE BLIND FOR ODDLY-SHAPED WINDOWS

(76) Inventor: Danelle Larsen, 12069 S. Kandi Cir., Riverton, UT (US) 84065

( * ) Notice: Subject to any disclaimer, the term of this patent is extended or adjusted under 35 U.S.C. 154(b) by 239 days.

This patent is subject to a terminal disclaimer.

(21) Appl. No.: 11/061,038

(22) Filed: Feb. 19, 2005

(65) Prior Publication Data

US 2006/0042760 A1 Mar. 2, 2006

Related U.S. Application Data

(63) Continuation-in-part of application No. 10/929,005, filed on Aug. 27, 2004.

(51) Int. Cl.
*E06B 3/48* (2006.01)

(52) U.S. Cl. ..... 160/84.04; 160/169; 160/84.07

(58) Field of Classification Search ..... 160/169, 160/172 R, 84.06, 84.04, 84.05, 84.07, 134, 160/84.08, 229.1
See application file for complete search history.

(56) References Cited

U.S. PATENT DOCUMENTS 2,415,222 A * 2/1947 Spencer ..... 160/107
4,685,986 A * 8/1987 Anderson ..... 156/197
4,901,419 A * 2/1990 Voss ..... 29/412
4,919,186 A * 4/1990 Uecker et al. ..... 160/321
4,934,436 A * 6/1990 Schnebly ..... 160/84.07
5,097,884 A * 3/1992 Sevcik et al. ..... 160/84.02
5,197,526 A * 3/1993 Schon ..... 160/84.07
5,425,408 A 6/1995 Colson
5,655,589 A * 8/1997 Vartanian ..... 160/166.1
5,765,619 A 6/1998 Arnold
6,257,301 B1 7/2001 Conforti
6,390,172 B1 5/2002 Fleishman et al.
6,478,071 B1 * 11/2002 Workman et al. ..... 160/84.04
6,651,722 B1 11/2003 Fleishman et al.
6,854,501 B2 * 2/2005 Corey ..... 160/84.05
6,932,138 B2 * 8/2005 Yu et al. ..... 160/84.01
2003/0070767 A1 4/2003 Workman et al.
2004/0112548 A1 6/2004 Militello et al.

* cited by examiner

*Primary Examiner*—Katherine Mitchell
*Assistant Examiner*—Candace L. Bradford
(74) *Attorney, Agent, or Firm*—David R. McKinney

(57) ABSTRACT

A window covering for an oddly-shaped window includes a panel, having a flexible bottom edge, and a top edge attached at a top of the window. The panel is configured to be drawn upward by the bottom edge to uncover the window, and to lower to a substantially planar configuration to substantially cover the window. The bottom edge is configured to at least partly conform to a shape of the top of the window when drawn up thereagainst. At least two pull cords are attached to the bottom edge, and are configured to raise and lower the panel.

18 Claims, 3 Drawing Sheets

ADJUSTABLE BLIND FOR ODDLY-SHAPED WINDOWS

PRIORITY CLAIM

The present application is a continuation-in-part of U.S. patent application Ser. No. 10/929,005, filed on Aug. 27, 2004, and entitled LOWERABLE BLIND FOR IRREGULARLY-SHAPED WINDOWS.

BACKGROUND OF THE INVENTION

1. Field of the Invention

The present invention relates generally to window coverings. More particularly, the present invention relates to an adjustable window covering for oddly-shaped windows.

2. Related Art

There are a wide variety of window coverings that have been developed to satisfy various desires for privacy and an aesthetically pleasing appearance. From simple vertical curtains to Roman shades, Venetian blinds, insulated blinds, cellular blinds, etc., window covering tastes and styles have changed over time, and new window covering types and styles have been developed to accommodate different tastes and window types.

There are many types of windows for which it is difficult to provide a suitable window covering. In recent years, oddly-shaped and hard-to-reach windows have become increasingly popular in homes in the United States. These include round or semi-round (e.g. octagonal, hexagonal. etc.) windows, arched windows, arched windows with vertical legs, and windows with angled tops or sides. Such windows are often located in hard-to-reach locations, such as above a door or another window, or high up adjacent a ceiling or fireplace chimney. While the proliferation of the number and types of windows is considered desirable to make homes bright and inviting, covering these windows can be a challenge.

Many people simply do not bother to cover oddly-shaped or hard-to-reach windows because of the difficulty of reaching and covering them. Some of these windows may be positioned such that privacy is not a significant issue. If the window is not located where an outsider could be expected to have an intrusive view inside, covering the window may be considered unnecessary. However, blocking light and direct sun can still be an issue, even if privacy is not. Direct sunlight can damage furniture and textiles, and can contribute to increased summer cooling costs.

Another reason people often do not cover their odd-shaped windows is because of the expense of the coverings that are available. Off-the-shelf coverings are not available for many windows that are a non-standard or uncommon size or shape, and the coverings that are available tend to be expensive. This is because of the high labor costs involved in creating a custom template for each unusual window prior to constructing the covering. On the other hand, there are some less expensive commercially available coverings for a few irregular window shapes, but many of these lack certain desirable features. For example, some, such as shutters, do not open and close, but have a permanent position, or may not be adjustable within a range of positions to vary their room-darkening ability. Others, such as Venetian blinds, cellular blinds, and sheer coverings, have limited room-darkening and/or heat-deflecting properties. Still others are difficult to install and/or remove, such as for cleaning. Some cannot be removed at all, once installed, without complete disassembly.

Other available window coverings do not have the desired decorative value. Where draperies, upholstery fabrics, bedspreads, etc. in a given room are specially selected and custom-made from a particular designer fabric, it can be desirable to have window coverings that match. This is common with conventional window coverings, but not with window coverings for irregularly-shaped windows, unless the coverings are selected from just a few basic types or are allowed not to match the shape of the window (e.g. straight pleated curtains placed in front of an arched window). The selection of coverings that are commercially available is small, and matching designer fabrics in a room can require creating an expensive one-of-a-kind solution.

SUMMARY OF THE INVENTION

It has been recognized that it would be advantageous to develop a low-cost covering for oddly-shaped windows that can be inexpensively produced from designer fabrics, so as to provide decorative value to match other textiles in a room.

It would also be advantageous to develop a low-cost covering for oddly-shaped windows that opens and closes, provides satisfactory room darkening and heat deflecting properties, is easy to install, and is easy to take down to clean.

In accordance with one aspect thereof, the invention provides a window covering for an oddly-shaped window, comprising a panel, having a flexible bottom edge, and a top edge attached at a top of the window. The panel is configured to be drawn upward by the bottom edge to uncover the window, and to lower to a substantially planar configuration to substantially cover the window. The bottom edge is configured to at least partly conform to a shape of the top of the window when drawn up thereagainst. At least two pull cords are attached to the bottom edge, and are configured to raise and lower the panel.

Additional features and advantages of the invention will be apparent from the detailed description which follows, taken in conjunction with the accompanying drawings, which together illustrate, by way of example, features of the invention.

DETAILED DESCRIPTION

Figure 1:
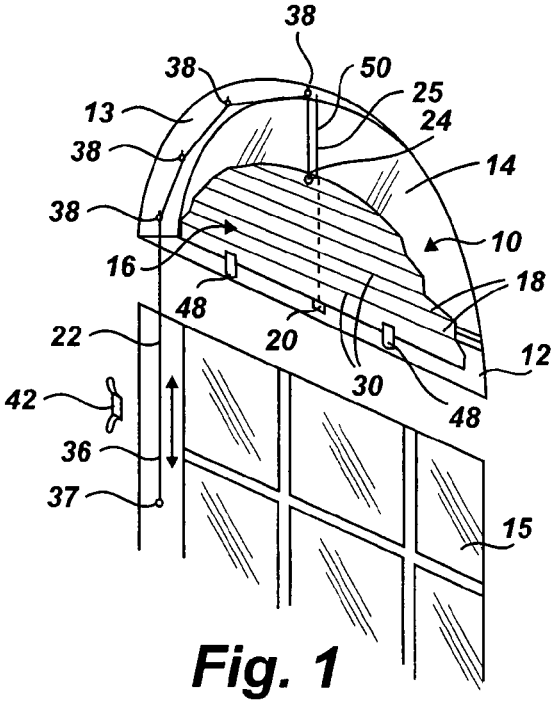
FIG. 1 is a perspective view of one embodiment of a window blind in accordance with the present invention, shown installed in an arched window.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The invention advantageously provides a lowerable blind for irregularly-shaped windows. As used herein, the term "irregularly-shaped" refers to a window that is not rectangular, has a substantially flat base, sill, or bottom boundary, and a top that is not wider than the base. The invention is particularly suited for arched windows, but is not limited to these. The top or top and sides of the window can have a variety of configurations, such as slanted, segmented, arched, or irregularly curved. The invention provides a vertically retractable window blind for various windows having one of these irregular shapes.

Advantageously, this window covering can be configured of a substantially continuous piece of designer fabric, as opposed to being limited to slats or some other discontinuous blind configuration, and allows economical coverage of rounded or otherwise oddly-shaped windows. As used herein, the term "designer fabric" refers to textiles or other flexible sheet products that are sold in bulk to consumers or other end-users, and are used to produce a wide range of products, such as upholstery, draperies, pillows, bed coverings, clothing, etc.

Designer fabrics present certain design challenges when making a window covering for an irregularly-shaped window. For instance, one cannot, as a practical matter, use designer fabrics to make a cellular shade without extensive material and labor costs. Because of their configuration, cellular shades generally require complicated automatic machinery to make them economically. Consequently, cellular shades are typically available in just a few pre-selected fabrics, and are generally not available in designer fabrics chosen by the user to match other decorative design elements in a room.

Figure 2:
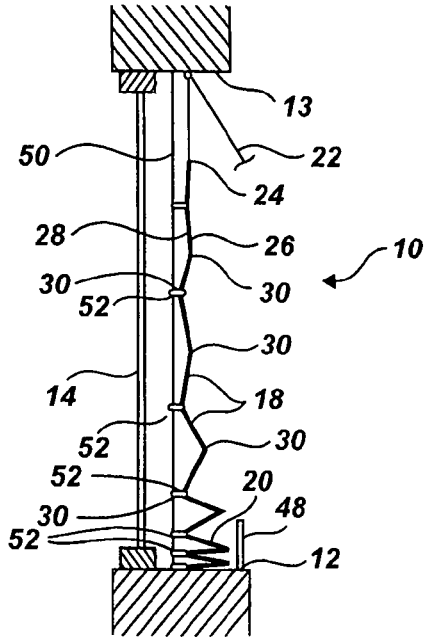
FIG. 2 is a cross-sectional view of the window blind of FIG. 1, taken along line 2-2 in FIG. 1.

In one embodiment, shown in FIGS. 1 and 2, the invention provides a window covering for an irregularly-shaped window, comprising an accordion-type window blind 10 configured to be installed on a sill 12 or other support member or surface in a window opening 13 at the base of a window 14. In FIG. 1, the depicted window is an arched window disposed above a lower rectangular window 15, the arched window having its own sill. However, it will be apparent that the invention is not limited to windows of this configuration, and need not rest upon a window sill. For example, the blind can be supported upon support brackets or other structure that supports blinds for the window below. Any structure that can support the blind adjacent to and generally aligned with the base of the irregularly-shaped window can be used.

The blind 10 generally comprises a panel 16, having a plurality of accordion folds 18, configured to fold up accordion-style in a stack 20 at the base of the window when not drawn, and to raise and unfold to produce a substantially flat panel when blockage is desired. A pull cord 22 is attached to the top edge 24 of the panel, to allow the blind to be raised and lowered as desired.

In the embodiment depicted in FIGS. 1 and 2, the panel 16 comprises a substantially continuous piece of flexible fabric. It is to be understood that the term "substantially continuous" does not imply that the blind must be of a single integral piece of fabric. For example, multiple individual pieces of fabric can be sewn together to form a substantially continuous piece of fabric. The panel has a front side 26 and a back side 28, the front side being the side toward the interior of the room, and the back being the side toward the window 14, or, in other words, the side that is visible from outside the window when the blind is closed. The front side can be a designer fabric, such as a fabric having a decorative pattern or weave, which can be selected to match design elements in the room. The back side can also be a designer fabric if desired, or it can be a less expensive material, such as a solid (i.e. non patterned) drapery backing fabric. With the use of designer fabrics, the user is able to obtain a coordinating look on the inside, while still maintaining a normal "blind" look on the outside.

In the embodiment depicted in FIGS. 1 and 2, the panel 16 includes a pleat 30 at the vertex 32 of each accordion fold. This pleat is sewn through the front fabric and the back fabric, and is configured to bias the fabric on opposing sides of each fold toward the accordion folding configuration. That is, each pleat is oriented in a direction opposite to that of the adjacent pleats, so that alternating pleats face in the same direction. Alternating pleats produce ridges on the front side of the panel, while the remaining alternating pleats create ridges on the back side of the panel when the panel is raised. This configuration causes each fold portion between the pleats to naturally tend to fold atop the portion below in the accordion configuration.

Because of its configuration, the top edge 24 of the blind 10 can be configured with any shape needed to conform to an arched or other irregularly-shaped window opening, so long as the base 12 of the window 14 is not narrower than the top. The top edge of the panel is shaped to match the shape of the top of the window, so that when raised, the blind substantially covers the entire window opening. Various decorative features can be added to the panel, such as decorative trim along its top edge. etc. Likewise, a valance (shown in dashed lines 35 in FIG. 5) or other feature can be added to disguise and cover the top edge of the blind when raised.

The pull cord 22 is attached to the top edge 24 of the blind panel 16, as noted above, and extends downwardly to a grasping end 36 at a position where a user can grasp it. The pull cord lifts the blind panel to the closed position, and holds it up in that position. The pull cord can be connected to the top edge of the blind panel via a releasable connector (25 in FIG. 1), such as a snap, a button (over which a loop in the end of the pull cord is looped), or any other device for releasably attaching a cord to the panel. The benefits of the releasable connection are discussed below. Where the width of the blind panel requires it, multiple pull cords can be provided to hold the blind panel in the raised position. The pull cord can be arranged in various ways. For example. as shown in FIG. 1, the pull cord can loop through a series of eyelets 38 across the top of the window opening 13, with a first eyelet disposed approximately at the top center of the window opening and successive eyelets disposed along the window opening toward the base. These eyelets draw the pull cord off to the side of the window, which reduces any obstruction, yet allows tension on the cord to be smoothly transmitted to lift the blind. It will be apparent that pulleys or other mechanical devices can be used in place of eyelets to route the pull cord as desired while still at allowing the transmission of tensile force.

Figure 4:
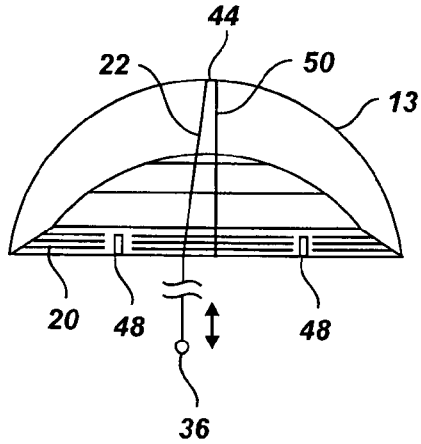
FIG. 4 is a front view of the blind of FIG. 1 having an alternative pull cord mechanism.

Other pull cord configurations can also be used. For example, as shown in FIG. 4, the pull cord 22 can be allowed to dangle straight down in front of blind 10. In this embodiment, the pull cord can be made just long enough to be reachable when the blind is down, so as to reduce its obtrusiveness. In yet another alternative embodiment, shown in FIG. 5, the pull cord can be threaded through a conduit 40 that is disposed along the window opening 13, from the top center region to a point along the side near the base 12 of the window opening, where the cord exits the conduit. This configuration draws the pull cord off to the side of the window, and also covers the cord to provide a neat appearance, white allowing free sliding of the cord within the conduit.

Figure 5:
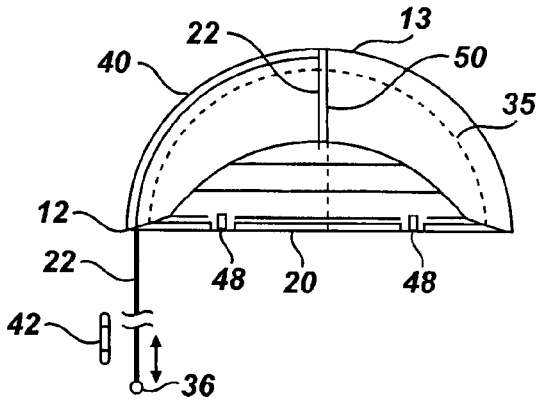
FIG. 5 is a front view of the blind of FIG. 1 having another alternative pull cord mechanism.

In any of the pull cord configurations shown or suggested herein, the pull cord 22 can be secured in various ways. In the embodiments of FIGS. 1 and 5, a cord hook 42 is attached to a wall (or some other stable surface) adjacent to the window opening 13 at a position that is reachable by a user. This allows the pull cord to be secured or tied-off to hold the blind in the raised position, and also allows a user to keep the cord neatly secured out of the way when the blind is in the lowered position. It is desirable to have the grasping end 36 of the pull cord to hang down past the cord hook by 4" or 5" when the blind is in the "down" position. The grasping end of the pull cord can include a knob 37, which may be removable, for facilitating grasping by the user. The user pulls the covering up tight against top of window by pulling the cord, and can then fasten it around the cord hook 4 or 5 times in a "FIG. 8" fashion. To let the covering down, the user simply un-loops the cord and applies tension to the cord while the covering slides down. Tension on the cord tends to help the curtain lay down better than merely letting go.

Alternatively, as shown in FIG. 4, the blind 10 can include a releasable pull cord locking device 44, such as the type of cam-lock device that is commonly used with Venetian blinds. The pull cord locking device is configured to selectively lock the pull cord 22 to hold the blind panel 16 in the raised or even partially raised position, yet can be easily released to lower the blind when desired. Advantageously, any of the pull-cord configurations disclosed herein allow the blind to be associated with windows that are high or hard to reach, so long as the pull cord is made long enough to reach. Thus the blind can be operated from essentially any position where the grasping end 36 of the cord is in reach.

The blind panel 16 includes a bottom flange or flap (46 in FIG. 3), which is configured to be attached to the base 12 or other structure at the bottom of the window 14. This attachment can be removable, such as with hook-and-loop connection fabric (e.g. Velcro®), adhesive, or other releasable connection devices. In the Velcro configuration, one part of the hook and loop fabric can be attached to the window base with adhesive, while the opposing portion of the hook and loop fabric is sewn to the bottom flap of the blind panel. The complete installation can also include one or more alignment brackets 48 for helping align and hold the blind in a neatly stacked configuration at the base of the window when lowered. When the blind is lowered, the alignment brackets guide the accordion folds to form a neat stack 20 atop each other at the base of the window.

The blind panel is attached to an alignment device which maintains a vertical alignment of the blind during raising and lowering, and prevents the blind from flopping away from the window instead of folding neatly at the base of the window when retracted. The alignment device can comprise a flexible or semi-elastic cord 50, such as strong transparent bracelet cord or comparable material, or it can be a rigid device and may be of non-transparent material. The alignment device provides a substantially vertical "spine," which extends between the base 12 of the window opening 13. and the top edge of the window opening adjacent the back side 28 of the panel 16. A plurality of sliding connectors 52 are attached to alternating vertices 32 of the accordion folds on the back side of the panel. In the embodiment depicted in FIGS. 2 and 3. the connectors are sliding rings that are sewn to each backward facing fold vertex 32 on the back side 28 of the blind panel, and strung along the alignment device. Where the width of a window and the blind warrants it, multiple alignment devices may be provided at horizontally-spaced locations, to maintain the alignment of the blind across its width.

The accordion folds 18 can be substantially horizontal, as shown, or can be in some other orientation, such as slanted, or in a fan-type arrangement. Because the blind is held in the raised position by the pull cord 22 (or multiple pull cords) it can be desirable to provide some stiffening mechanism to prevent or reduce sagging of the blind away from the connection point of the pull cord when raised. To address this issue, the inventor has provided an elongate stiffener pocket 54 in the fabric between each accordion fold, shown in FIG. 3. These elongate pockets are open on at least one end, and are configured to receive a lateral stiffener 56 in each accordion fold, so as to reduce horizontal sagging of the panel 16.

Figure 3:
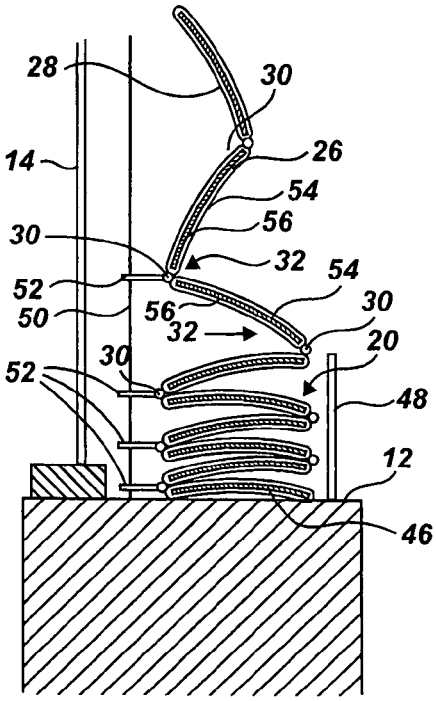
FIG. 3 is a close-up cross-sectional view of a portion of the window blind of FIG. 1, showing the stiffeners disposed in the stiffener pockets.

Appropriate stiffeners 56 will typically have a length and width corresponding to their respective stiffener pocket 54, and can vary in thickness, depending on the material of the stiffener. A plurality of stiffeners can be cut to varying lengths corresponding to the lengths of the stiffener pockets (which vary with the shape of the blind panel), and inserted into each stiffener pocket. As shown in FIG. 3, when the blind is down, the accordion folds with the stiffeners therein lay atop each other in the compact stack 20. When the blind is raised, the stiffeners are turned on edge, placing their strong axis in a vertical orientation, so as to minimize horizontal sagging of the blind panel.

A variety of types of stiffeners 56 can be used, such as metal (e.g. aluminum), wood, or plastic. Other materials are also possible. Likewise, the width and thickness can vary. One type of stiffener that has been used successfully by the inventor is a vinyl mini-blind slat. These slats are thin, yet wide enough to provide good stiffness when turned on edge. Moreover, these types of slats ate widely available, and the stiffener pockets can be easily sized to accommodate them. As shown in FIG. 3, mini-blind slats generally have a transverse curvature to provide strength when these slats are horizontal. In the present invention, the accordion folds are horizontal only when the blind is lowered, and no horizontal strength is required at that time. However, the transverse cupping of the slats does suggest that they be inserted into the stiffener pockets in alternating orientation, so that the slats assume a common orientation to nest atop each other when the blind is down, as shown in FIG. 3. This helps make the accordion-folded configuration more compact.

Figure 7:
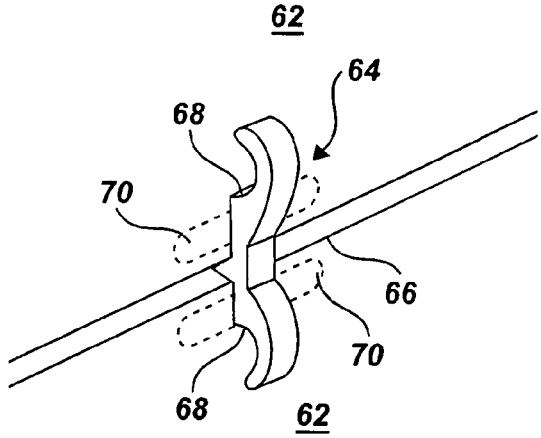
FIG. 7 is a close-up perspective view of a pivoting link and attached slats of the blind of FIG. 6.
Figure 6:
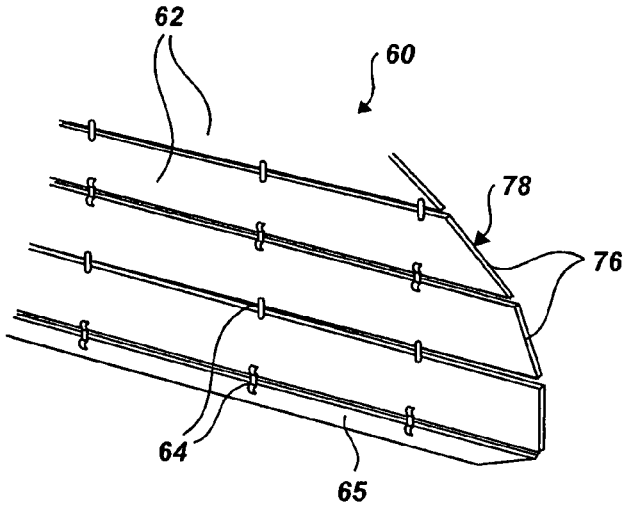
FIG. 6 is a partial front perspective view of an alternative embodiment of a blind in accordance with the present invention, the blind panel comprising a plurality of hingedly linked slats.
Figure 8:
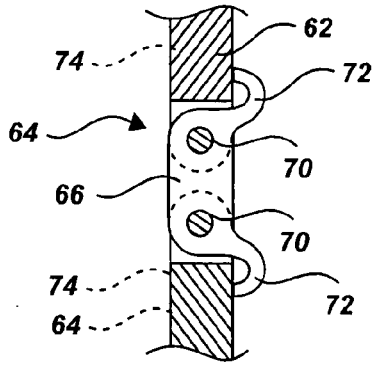
FIG. 8 is a side cross-sectional view of the pivoting link and attached slats of FIG. 7.

In an alternative embodiment according to the present invention, the window covering panel can comprise a plurality of substantially rigid slats that are hingedly attached together. Such an embodiment is depicted in FIGS. 6-8. In this embodiment, the window covering 60 comprises a plurality of separate horizontal slats 62 that are hingedly connected together, such as with pivoting links 64. A bottom slat 65 provides structure comparable to the bottom flange 46 for connection of the blind to the base of the window opening. The slats can be of a variety of materials, such as wood, plastic (e.g. vinyl), metal (e.g. aluminum), or other suitable material. Additionally, individual rigid slats could be covered with a fabric or other decorative surface feature, and this could be selected to match decorative elements in a room. Likewise, the front and hack sides of the slats can be treated differently, such as providing a light reflective surface on the back of the slats. with a decorative surface on the front of the slats. Many other combinations are also possible.

As shown in FIGS. 6 and 7, the pivoting links 64 comprise a link body 66 disposed in corresponding slots 68 in each pair of adjacent slats 62. The pivoting link has a pair of horizontal pivot pins 70 that extend transversely therethrough, one pivot pin being attached in one slat and the other pivot pin being attached in the other slat. The pivoting link and pivot pins can be configured such that the link pivots on the pins, or such that the pins pivot in their respective attachment points in the slats. Because the slats are hinged together, they will easily fold into the accordion configuration at the bottom of the window, yet, when raised, open up to substantially flat panel to block the window.

To bias the slats to fold up in the proper accordion manner, the assembly includes a biasing device, associated with each pair of hingedly connected slats 62, configured to bias the slats toward the accordion folding configuration. In one embodiment, shown in the figures, the biasing device comprises resilient tabs 72, extending from each end of each pivoting link 64, an contacting one side of each adjacent slat to bias the slats to pivot in one direction relative to that pivoting link. The resilient tabs are flexible, and have a relaxed position (shown in hidden lines 74 In FIG. 8), and a distended or flexed position, shown in solid lines in FIGS. 7 and 8. The pivoting links with resilient tabs are oppositely oriented at adjacent slat junctions, so that as the blind is lowered and the straight line orientation of each pair of blinds begins to relax, the resilient tabs will gently urge their respective connections to fold in the desired direction. As lowering continues, the weight of each slat will naturally cause this folding process to continue, to provide the desired accordion folded configuration.

The pull cord and other blind features noted above with respect to the fabric blind embodiment can be configured and operate in the same manner with the slat-type blind con figuration of FIGS. 6-8. For example, connectors (not shown in FIG. 6) can be attached to one slat 62 of each linked pair at the back side of the panel to allow connection to an alignment device. Likewise, the ends 76 of the slats can be cut and shaped so that the top edge 78 of the entire assembly of slats corresponds to the shape of the window opening when raised. The pull cord can also be attached to the top slat with a removable connector, as described below.

Advantageously, any embodiment of the blind disclosed herein can be configured for easy removal from the window, to allow washing, cleaning, dusting, etc. Removal of the blind panel 16 generally requires that the pull cord 22 be disconnected, and that the connecting rings 52 be detached from the alignment cord 50. These steps can be performed in several different ways. In one approach, the pull cord knob (37 in FIG. 1) is first removed from the pull cord, after which the pull cord can be retracted through the eyelets 38 or other structure attached around the window opening. Alternatively, where the pull cord is attached to the blind panel with a removable connector (25 in FIG. 1), this connector can be detached from the top of the blind panel. To allow detachment of the connecting rings, the vertical alignment device can be configured to be removable from the window opening. In one embodiment, where the alignment device is a semi-elastic cord, the top of the cord can include a hook (such as a flexible hook) that attaches to an eyelet installed in the top of the window opening. After detaching the hook, the user can easily thread each connecting ring off of the free end of the cord.

Once the pull cord 22 and alignment cord 50 are detached from the blind panel, the bottom flange (46 in FIG. 3, 65 in FIG. 6) of the blind panel can be detached from the window base 12 (or other support structure), and the entire panel can be removed from the window opening 13. In the hinged slat embodiment of FIGS. 6-8, the removed blind panel 60 can then be dusted, washed or otherwise cleaned in any suitable manner, then returned to the window opening and reinstalled. With the fabric embodiment of FIGS. 1-5, once the blind panel 16 is removed from the window opening, the stiffener slats 56 can be easily removed from each stiffener pocket 54, and the entire fabric panel can be washed or otherwise cleaned. If appropriate for the fabric of the panel, the panel can be machine washed. After cleaning, the stiffeners are then replaced, and the blind panel can be reinstalled in the window opening 13 in the same manner in which it was removed. The removeability of the blind in any of its configurations adds to the overall convenience of this window covering.

As noted above, the labor involved in creating a custom window covering for an irregularly-shaped window can be quite extensive following conventional methods. Advantageously, the inventor has developed a method for rapidly creating a template and pattern for each unusual window prior to constructing a fabric panel window covering. It will be apparent, for example, that the raw fabric panel (prior to sewing) cannot be the exact size and shape of the window opening. Rather, the fabric panel must include the bottom flange, and must include sufficient excess to accommodate the fabric consumed by each pleat. The amount of excess fabric required by the pleats can be termed a "pleat loss." Additionally, the entire panel must also allow for some residual "puckering loss." That is, while the fabric panel assumes a substantially planar configuration when raised, it will probably not be entirely flat, depending on the stiffness of the fabric. When raised, there may still be some residual accordion-folded shape to the panel. This phenomenon is depicted in FIG. 2. Consequently, the actual size of the fabric panel may need to be slightly larger than the actual window opening.

To accommodate the pleat loss and the puckering loss, the inventor first measures the size and shape of the window opening to be covered. Then, a pattern is created that elongates the window shape according to the total pleat loss and puckering loss. The total pleat loss depends upon the number of pleats required, which depends upon the size of the pleats (e.g. ⅛" or ¼"), and the number of pleats. The number of pleats depends upon the number of stiffener pockets, which in turn depends upon the width of the stiffener slats that will be used, relative to the height of the window opening. It will also be apparent that the stiffener pockets must be slightly wider than the stiffener slats to allow these slats to be inserted.

The total puckering loss generally depends upon the overall size or height of the fabric panel, and the stiffness of the fabric. A taller panel will be heavier, and thus will be stretched by gravity more than a lighter panel, hence experiencing a smaller puckering loss. On the other hand, a stiffer fabric will tend to promote the residual accordion-folded shape, hence producing larger puckering loss. Through experience, the inventor has found that the total puckering loss tends to range from about 3% up to nearly 20% of the total window height. Calculating this amount generally requires some knowledge and experience with various fabrics, and may require some trial and error.

To speed the calculation of the pleat loss and puckering loss, the inventor has developed a computerized computational method that takes the window dimensions, the width of stiffeners to be used, and then automatically calculates the pleat loss, and factors in the expected puckering loss. Once the total pleat loss and total puckering loss are determined, the computer determines the size and shape of the required blind pattern. The pattern shape will tend to look like a vertically elongated version of the window opening. For example, for a half-round arch window, like that shown in FIG. 1 the pattern will have an elongated semi-elliptical shape, rather than the semi-circular shape of the window itself. Those skilled in the art will recognize that the pattern will also have to provide fabric for seams, hems, the bottom flange, etc. to allow sewing.

Once the pattern is prepared in the proper size and shape, the front side and back side fabrics can be cut to match, and the panel can then be sewn together to produce the series of pockets and pleats needed for the full blind pattern. To complete the fabrication of the blind panel, the connecting rings are sewn into each rear-facing pleat, and the releasable attachment devices (e.g. Velcro) are attached to the bottom flange. Finally, a series of slats are cut to match the length and end shape of each stiffener pocket, and are inserted into each corresponding stiffener pocket. The finished blind panel can then be placed into the window opening, and attached to the alignment cord and pull cord.

Because of the simple design and unique configuration of this window covering, production costs are drastically reduced. Moreover, the inventor is not aware of any other blinds like this that use designer Fabrics in a bottom-up style blind. This window covering meets a long felt need in the window covering industry. The blind opens and closes, it is room-darkening and heat-deflecting, it can be made of designer fabric to provide decorative value (matches furniture, bedspreads etc.), is easy to install, is easy to take down and clean, and is inexpensive. The window covering provides a unique alignment device that uses a ring "spine" to hold the covering close to the window, and not allow the covering to sag or fall away from the window when being raised or lowered. The blind panel can attach at the base with an adhesive hook fastener and sew-on loop fastener. The spine and pull-cord can be made of a clear material so as to be unobtrusive, yet strong, and the pull-cord can be any desired length, thus making the covering very functional, even for high windows. The stiffener slats give the fabric panel the definite shape of the window.

While the window covering of this invention is depicted as either a generally flat panel or series of slats, other configurations are also possible. For example, the blind panel could be configured as a cellular-type blind, a Roman shade, or in other configurations.

Figure 9:
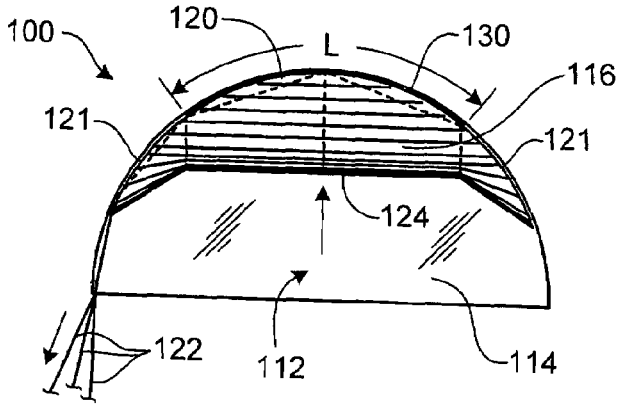
FIG. 9 is a front view of an alternative embodiment of a window blind wherein the blind is configured to be raised to open, the blind being shown in the open position.
Figure 11:
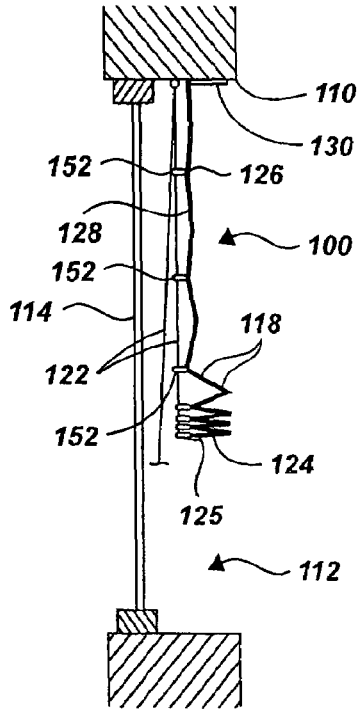
FIG. 11 is a side cross-sectional view of the blind of FIGS. 9 and 10, showing the blind in a partially raised position.
Figure 10:
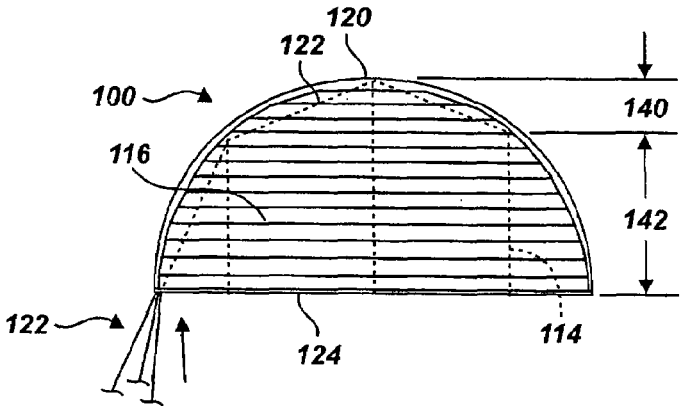
FIG. 10 is a front view of the window blind of FIG. 9, the blind being shown in the lowered position.

While the various window blind embodiments discussed above are bottom-up style blinds, a top-down style blind can also be made in accordance with the present invention. One embodiment of a top-down window blind 100 is depicted in FIGS. 9-11. This embodiment is configured to be attached to the header or top 110 of an opening 112 for a window 114. Like the embodiments discussed above, the blind generally comprises a panel 116, having a plurality of accordion folds 118, configured to fold up and stack accordion-style as the blind panel is raised (i.e. drawn up) in the window opening, and to unfold as it is lowered to produce a substantially flat panel when blockage of the window is desired.

As with the embodiment of FIG. 1, discussed above, the panel 116 comprises a substantially continuous piece of flexible fabric. The panel has a front side 126 and a back side 128, the front side being the side toward the interior of the room, and the back being the side toward the window 114. The front side can be a designer fabric, and the back side can be a designer fabric or some other material. The panel has the double pleat configuration discussed above, the pleats being configured to bias the fabric toward the accordion folding configuration.

The top edge 120 and side edges 121 of the blind panel 116 are configured to conform to the shape of the window opening. The top edge of the panel is provided with a mounting strip or flange 130, which attaches to the top of the window opening. This mounting strip can be configured to attach to the window opening using any suitable method. For example, adhesives or fasteners can be used to directly attach the flange to the window opening. Alternatively, a hook and loop fastening system can be used, with one strip of material (e.g. the "hook" material) adhered to the window opening, and the corresponding strip of material (e.g. the "loop" material) attached to the mounting flange. Whatever mounting system is chosen, it is desirable that the blind panel be removable from the window opening, and yet be securely held in the window opening during use. Various decorative features, such as decorative trim, a valance, etc. can also be added to disguise and cover the edges of the blind.

The mounting strip or flange 130 need not extend across the entire width of the panel. For example, as shown in FIGS. 9 and 10, the mounting strip or flange extends along a length L of the top edge of the panel from a position adjacent to one outer pull cord to a position adjacent the other outer pull cord. The mounting strip should provide sufficient strength to hold the blind in place, and also helps to stiffen the upper portion of the fabric panel.

The fabric panel 116 is configured in substantially the same manner as described above with respect to the embodiment of FIG. 1. The panel comprises a series of pockets into which stiffeners can be inserted. However, stiffeners need not be inserted into all pockets of the top-down blind embodiment. In order to have sufficient strength to provide a generally straight bottom edge when raised, multiple stiffeners or a more rigid stiffener are placed in the bottom-most stiffener pocket. However, the bottom stiffener is also flexible enough to bend in response to variation in the window shape. For example, as shown in FIG. 9, that portion of the bottom edge of the panel that is outward of the outer pull cords deflects downwardly due to contact with the outer edges of the window opening when raised. This flexibility of the bottom slat allows the blind to be drawn up into a window opening that contracts in width with increased height. Indeed, with sufficient flexibility of the bottom slat, the blind can be drawn up to conform very closely to the shape of the top of the window opening, for maximum exposure of the window.

Stiffeners can also be provided in the uppermost stiffener pockets 140 of the blind, though this is optional. No slats are needed in the middle region 142 of the blind panel. Indeed, the provision of too many slats in the region directly above the bottom slat 124 can reduce the flexibility of the bottom slat, thus possibly reducing the height to which the blind can be drawn, depending on the shape of the window opening.

Two or more pull cords 122 (depending upon the maximum width of the blind panel) are attached to the bottom edge or bottom slat 124 of the panel, to allow the blind to be raised and lowered as desired. The pull cords extend downwardly to a grasping end (not shown) for grasping by a user. The pull cords lift the blind panel from the closed position, and hold it up in the open position when desired. To raise the blind and uncover the window, a user simply pulls downwardly on the pull cords, as shown in FIG. 9. To lower the blind and cover the window, the user allows the pulling end of the pull cords to rise up, allowing the blind to drop down over the window, as shown in FIG. 10.

In the top-down configuration, the pull cords 122 double as a "spine", holding the folds of the panel 116 in a vertical alignment when the blind is lowered, and also as it is being raised. The configuration and operation of the spine are more clearly visible in the cross-sectional view of FIG. 11. An alignment ring or connector 152 extends from the rearward junction of each accordion fold, in line with each pull cord. The rings or connectors can be attached to the blind panel using any suitable method. The respective pull cord is routed through these rings, and slides through them as the blind is raised and lowered. The pull cords will naturally assume a straight vertical orientation due to the pull of gravity on the bottom slat 124, and will thus align the alignment rings to keep the panel in a substantially planar vertical orientation, both when lowered, and as the blind is being raised.

It will be apparent that the number of accordion folds in the blind panel is variable. The blind panel can have a large number of very small accordion folds, or just a few very large ones. Indeed, the top-down blind embodiment can also be created without an accordion-folding configuration. That is, the blind can be a substantially continuous panel that is attached at its top to the window opening, and includes a pull cord that extends to its lower edge. The panel can entirely lack alignment rings or connectors on its back side between the bottom edge and the top, and simply billow out or bunch up in a random fashion as the flexible bottom edge is drawn upward to the top of the window opening. Alternatively, the panel can include any number of alignment rings—from one or two to very many—attached to the back of the panel between the bottom edge and the top. Even with alignment rings, the panel can be configured without a specific accordion folding configuration. That is, the alignment rings can be attached to the back of the panel at any location, but need not be attached at a vertex of an accordion fold.

The pull cord 122 can be connected to the bottom slat 124 of the blind panel via a releasable connector 125, such as a snap, a button, a hook, or any other suitable device. The pull cords can also be arranged in various ways. As shown in FIGS. 9 and 10, the panel can have multiple pull cords to support the bottom slat. Various pull cord mechanisms, as discussed above, can be employed for routing and securing the pull cords. To remove the blind from the window opening, such as for cleaning, the user simply detaches the pull cords from the bottom slat, withdraws the pull cords through the alignment rings or connectors 152, and detaches the top flange or mounting strip 130 from the top edge of the window opening. The panel can be easily reinstalled by following the reverse of these steps.

Advantageously, the top-down blind embodiment is not limited to use with irregularly-shaped windows, as that term is defined herein. As noted above, the term "irregularly-shaped" is used herein to refer to a window that is not rectangular, has a substantially flat base, sill, or bottom boundary, and a top that is not wider than the base. The top-down embodiment, in contrast, can be used with both irregularly-shaped windows and oddly-shaped windows. As used herein, the term "oddly-shaped" is broader than "irregularly-shaped," and refers to windows that are not rectangular, but does not require the other limitations of "irregularly-shaped." Specifically, for the top-down embodiment there is no requirement that the window have a substantially flat base, sill, or bottom boundary, or a top that is not wider than the base. Because the blind panel is configured to match the shape of the window opening, and is attached to the top of the window opening, the bottom and intermediate portions of the window opening can be any shape. For example, while the embodiment of FIGS. 9 and 10 is shown installed in an arched window, it could be just as easily installed in a complete round window, or a hexagonal window, or any other shape.

It is to be understood that the above-referenced arrangements are illustrative of the application of the principles of the present invention. It will be apparent to those of ordinary skill in the art that numerous modifications can be made without departing from the principles and concepts of the invention as set forth in the claims.

What is claimed is:

1. A window covering for a window in an oddly-shaped window opening, comprising:

a panel, having accordion folds, a flexible bottom edge, and a top edge attached at a top of the window opening, configured to be drawn upward by the bottom edge in an accordion folding configuration to uncover the window, and to lower to a substantially planar configuration to substantially cover the window, the bottom edge being configured to at least partly conform to a shape of the top of the window opening when drawn up thereagainst;

at least two pull cords, attached to the bottom edge, configured to raise and lower the panel; and a pleat sewn through the panel at each vertex of each accordion fold, configured to bias the panel on opposing sides of each fold toward the accordion folding configuration.

2. A window covering in accordance with claim 1, wherein a region of the bottom edge of the panel, outward of the at least two pull cords, is configured to downwardly deflect from contact with sides of the window opening.

3. A window covering in accordance with claim 1, further comprising stiffeners, disposed in at least one of the accordion folds, so as to reduce horizontal sagging of the panel.

4. A window covering in accordance with claim 3, wherein the bottom edge comprises a bottom accordion fold, and further comprising a stiffener disposed in the bottom accordion fold.

5. A window covering in accordance with claim 4, wherein the stiffener disposed in the bottom accordion fold is configured to substantially conform to the shape of the top of the window opening when drawn up thereinto.

6. A window covering in accordance with claim 1, further comprising an elongate pocket in the panel between each accordion fold, configured to receive a lateral stiffener.

7. A window covering in accordance with claim 1, further comprising an alignment device, configured to retain a substantially vertical alignment of the panel during raising and lowering.

8. A window covering in accordance with claim 7, wherein the alignment device comprises connectors, attached in vertical alignment to a back side of the panel, and slidingly disposed along one of the pull cords.

9. A window covering in accordance with claim 1, wherein the panel comprises a substantially continuous piece of flexible fabric.

10. A window covering in accordance with claim 1, wherein the panel is removably attached at the top of the window.

11. A window covering in accordance with claim 1, wherein the pull cords are releasably attached to the bottom edge of the panel.

12. A window covering in accordance with claim 7, wherein the alignment device comprises connectors, attached in vertical alignment to a vertex of alternating opposing accordion folds on a back side of the panel, and slidingly disposed along one of the pull cords.

13. A window covering for an oddly-shaped window, comprising:

a panel, comprising a substantially continuous piece of flexible fabric having accordion folds, the panel having a top edge removably attached at a top of the window, being configured to be drawn upward and fold in accordion-fashion to uncover the window, and to lower and unfold to a substantially planar configuration to substantially cover the window;

a least two pull cords, attached to a bottom edge of the panel, configured to raise and lower the panel;

a pleat, sewn through the panel at each vertex of each accordion fold, configured to bias the fabric on opposing sides of each fold toward the accordion folding configuration; and connectors, attached in vertical alignment to a vertex of alternating opposing folds on a back side of the panel, and slidingly disposed along one of the pull cords, so as to retain a substantially vertical alignment of the panel during raising and lowering.

14. A window covering in accordance with claim 13, further comprising a stiffener, disposed in at least one of the accordion folds, so as to reduce horizontal sagging of the panel.

15. A window covering in accordance with claim 14, wherein the stiffener is disposed in a bottommost accordion fold, and is configured to flex to substantially conform to the shape of the top of the window opening when drawn up thereagainst.

16. A window covering in accordance with claim 13, further comprising an elongate pocket in the fabric between each accordion fold, configured to receive a lateral stiffener.

17. A window covering in accordance with claim 13, wherein the pull cords are releasably attached to the bottom edge of the panel.

18. A window covering for an oddly-shaped window, comprising:

a panel, comprising a substantially continuous piece of flexible fabric having accordion folds, the panel having a top edge removably attached at a top of the window, being configured to be drawn upward and fold in accordion-fashion to uncover the window, and to lower and unfold to a substantially planar configuration to substantially cover the window;

a stiffener, disposed in at least one of the accordion folds, so as to reduce horizontal sagging of the panel;

at least two pull cords, releasably attached to a bottom edge of the panel, configured to raise and lower the panel;

a pleat, sewn through the panel at each vertex of each accordion fold, configured to bias the fabric on opposing sides of each fold toward the accordion folding configuration; and connectors, attached in vertical alignment to a vertex of alternating opposing accordion folds on a back side of the panel, and slidingly disposed along one of the pull cords, so as to retain a substantially vertical alignment of the panel during raising and lowering.

* * * * *